US005815852A

United States Patent [19]

Fleming

[11] Patent Number: 5,815,852

[45] Date of Patent: Oct. 6, 1998

[54] TOILET WITH INTERNAL RINSE MECHANISM

[75] Inventor: David Charles Robert Fleming, Grimsby, Canada

[73] Assignee: Sanitation Equipment Limited, Concord, Canada

[21] Appl. No.: 887,851

[22] Filed: Jul. 3, 1997

[51] Int. Cl.[6] ..... E03D 11/10

[52] U.S. Cl. ..... 4/435

[58] Field of Search ..... 4/434–439

[56] References Cited

U.S. PATENT DOCUMENTS

| | | | |
|---|---|---|---|
| 283,172 | 8/1883 | Walsh | 4/438 |
| 307,668 | 11/1884 | McAndrews | 4/439 X |
| 3,247,525 | 4/1966 | O'Brien | 4/438 |
| 4,710,988 | 12/1987 | Stewart | 4/434 X |

*Primary Examiner*—Charles E. Phillips
*Attorney, Agent, or Firm*—Bereskin & Parr

[57] ABSTRACT

A flush toilet, for example, for use in a recreational vehicle comprises two main plastic mouldings, one of which includes the toilet bowl and the other of which forms a "shell" or outer housing in which the bowl is supported so that the bowl outlet is located in an internal space defined by the shell. In accordance with the invention, the toilet is provided with a flushing mechanism that includes a bowl rinse nozzle adjacent the rim of the bowl and an internal rinse nozzle for rinsing the walls of the internal space and flushing mechanism within the outer shell. This reduces the risk of odours developing from contamination of the shell and also means that the shell is relatively clean inside in the event that servicing of the toilet is required.

8 Claims, 5 Drawing Sheets

40a
40c
40
40b

A
46
58
40
42
63
78
28
72
68
76
66
64
70
74
80
30
63
22
86
84
34
36
24
20

TOILET WITH INTERNAL RINSE MECHANISM

FIELD OF THE INVENTION

This invention relates generally to flush toilets of the type typically used in recreational vehicles and other "occasional use" environments. It is, however, to be understood that the invention is not limited to toilets for these applications.

1. Background of the Invention

A toilet for a recreational vehicle typically comprises two main plastic mouldings, one of which includes the toilet bowl and the other of which forms a shell or outer housing in which the bowl is supported. The bowl has a waste outlet that discharges into an internal space defined by the outer shell and the outer shell in turn has an outlet at its lower end which is the main waste outlet of the toilet. In a recreational vehicle, the toilet is installed so that this main outlet communicates with a waste disposal conduit from the vehicle. A valve or other closure member normally closes the bowl outlet but can be opened for flushing the toilet.

With continued use of the toilet, the internal walls of the outer shell around and below the bowl outlet can become contaminated with waste that is not completely removed when the toilet is flushed. Contamination of the bowl closure mechanism can also occur. In some cases, such contamination can lead to unpleasant odours seeping out of the toilet upwardly through the bowl outlet. At the very least, the contamination makes it unpleasant and possibly even hazardous for personnel who may be called upon to service the toilet in future.

2. Description of the Prior Art

U.S. Pat. No. 4,710,988 (Stewart) assigned to Sanitation Equipment Limited discloses a toilet of the general type discussed above. Provision is made to rinse the toilet bowl and the upper surface of a bowl closure valve when the toilet is flushed. The disclosure of the Stewart patent is incorporated herein by reference.

U.S. Pat. No. 525,104 (Herrick) discloses a toilet for a railway car in which flush water apparently can be selectively directed into the toilet bowl or into a receptacle below the bowl. United States patents to Lacore (U.S. Pat. No. 4,527,295) and Berry (U.S. Pat. No. 1,113,186) show rinse mechanisms for toilet holding tanks, while Carlson (U.S. Pat. No. 5,421,904) and Faxon (U.S. Pat. No. 5,551,458) show rinse mechanisms for cleaning pipes. Toilet systems for recreational vehicles are disclosed generally in patents to Wise (U.S. Pat. No. 4,785,483) and Sargent (U.S. Pat. No. 5,031,249).

None of these prior proposals offers a solution to the problem outlined above, namely contamination of the walls of the outer shell or housing of a toilet, e.g. for a recreational vehicle.

SUMMARY OF THE INVENTION

Accordingly, it is an object of the present invention to remedy this short-coming in the prior art.

The present invention provides an improvement in a toilet of the type outlined above, namely a toilet which includes a bowl for receiving waste and having an outlet and a rim, and a housing in which the bowl is supported, the housing defining an internal space in which the bowl outlet is located and having a main waste outlet from the toilet below the bowl outlet so that waste from the bowl passes by gravity to the main waste outlet. The toilet also includes bowl closure means normally closing the bowl outlet and operable to open the outlet for flushing of the toilet. The improvement provided by the invention comprises toilet rinsing means including at least one bowl rinse nozzle adjacent the rim of the bowl and an internal rinse nozzle within the internal space defined by the housing for rinsing waste that may tend to accumulate in the space when the toilet is in use. The toilet has a water inlet and means providing communication between the inlet and the bowl rinse and internal rinse nozzles, including a water valve and diffuser means downstream of the valve having first and second outlets communicating respectively with the bowl rinse nozzle and internal rinse nozzle, the outlets being sized so that the volume of water delivered to the internal rinse nozzle is lower than the volume of water delivered to the bowl rinse nozzle.

In summary, the present invention addresses the contamination problem outlined above by providing for pressure rinsing of the interior of the housing of the toilet, without detracting from proper rinsing of the toilet bowl itself. In an environment such as a recreational vehicle the available water supply normally will be limited. Accordingly, it is of paramount importance that an adequate volume of water be used for the main rinse (of the bowl); by appropriate relative sizing of the outlets from the diffuser means, this objective can be achieved while allowing for adequate low-volume rinsing of the interior of the toilet.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
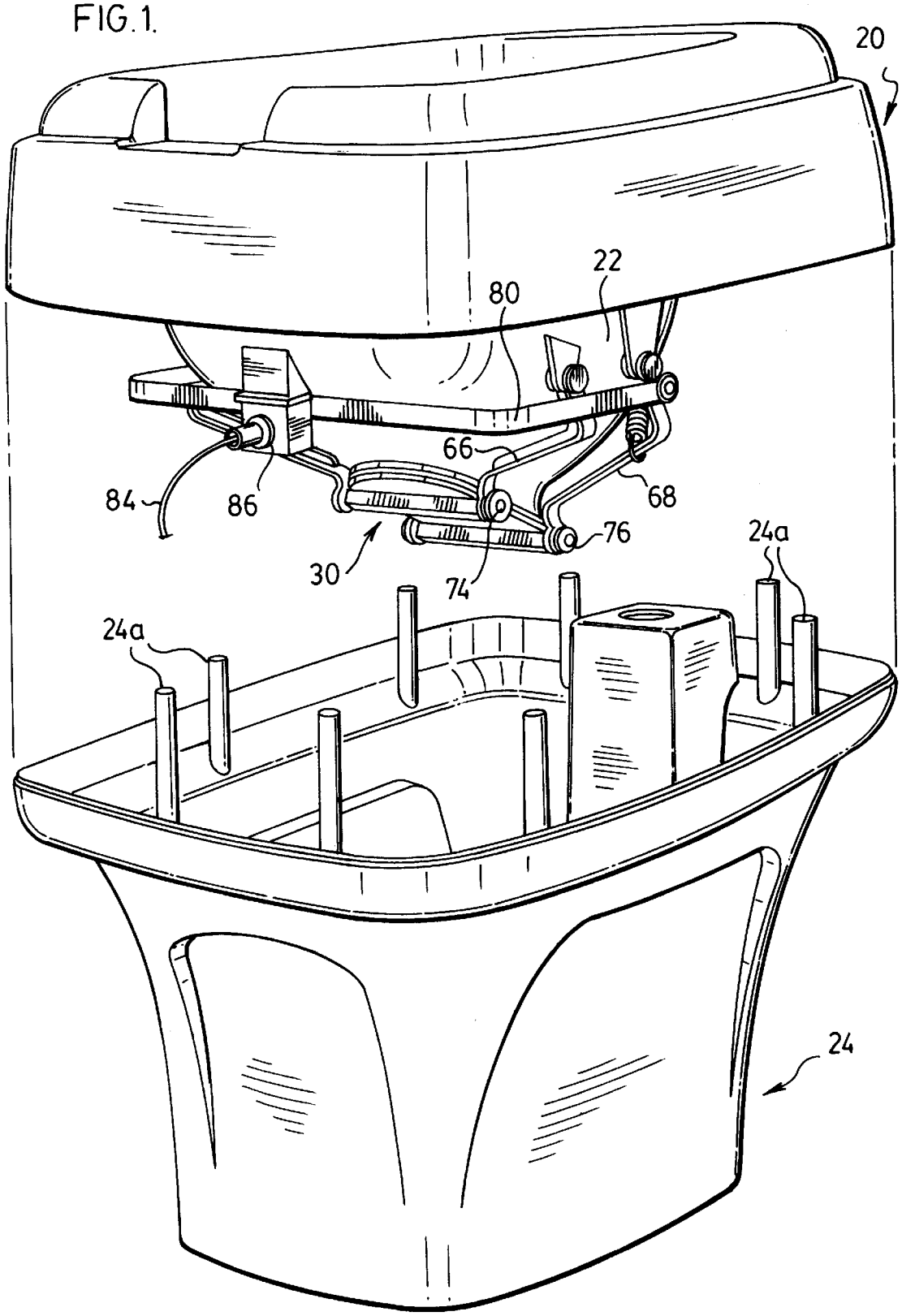
FIG. 1 is a perspective view of a toilet in accordance with the invention, in which two main plastic mouldings forming the bowl and "shell" of the toilet are shown in exploded positions.
Figures 2, 2A:
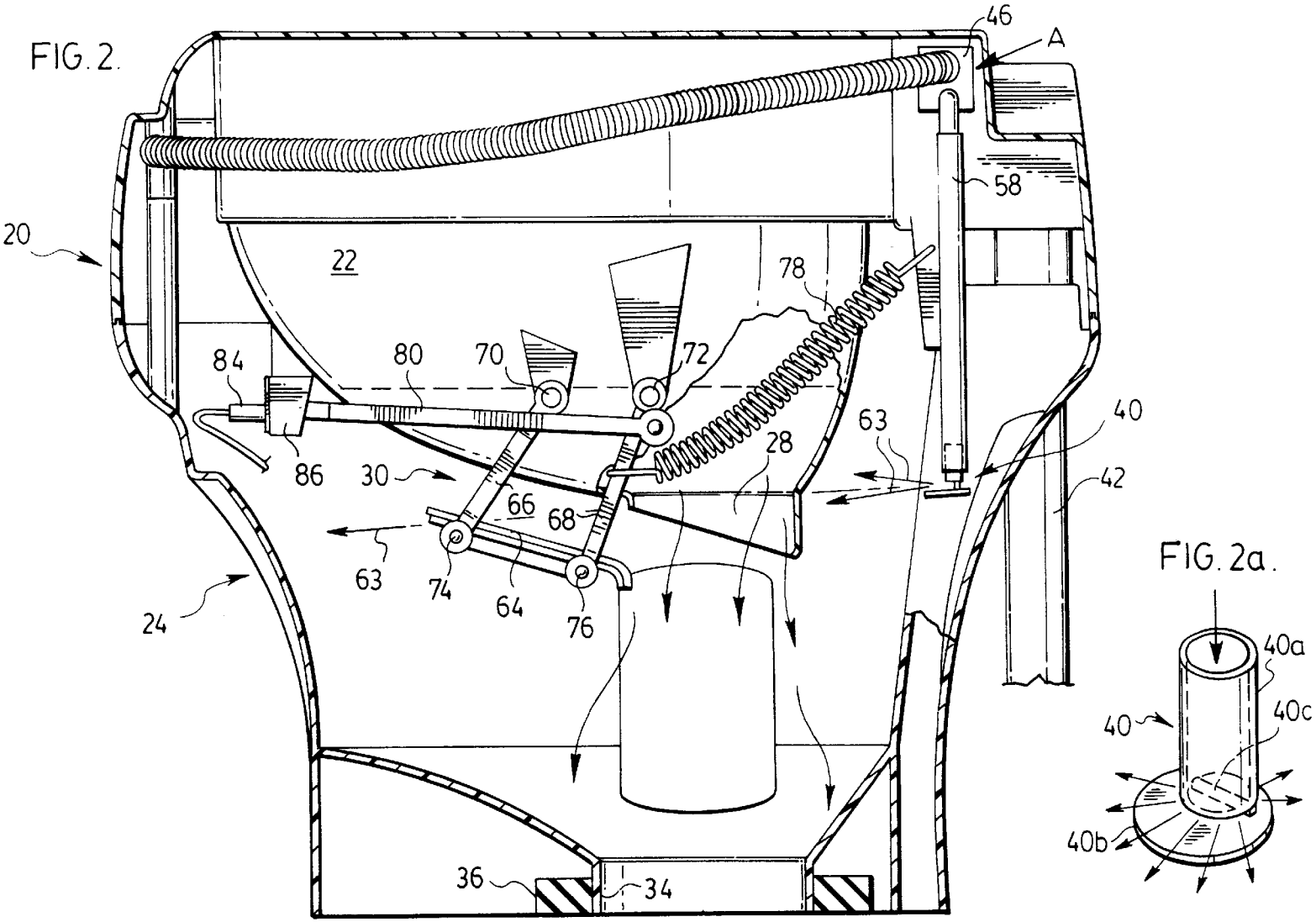
FIG. 2 is a view from the right in FIG. 1 showing the toilet as assembled and the two plastic mouldings in vertical section, with the bowl seal valve of the toilet open.
FIG. 2*a* is a perspective view of an internal rinse nozzle shown in FIG. 2.
Figure 3:
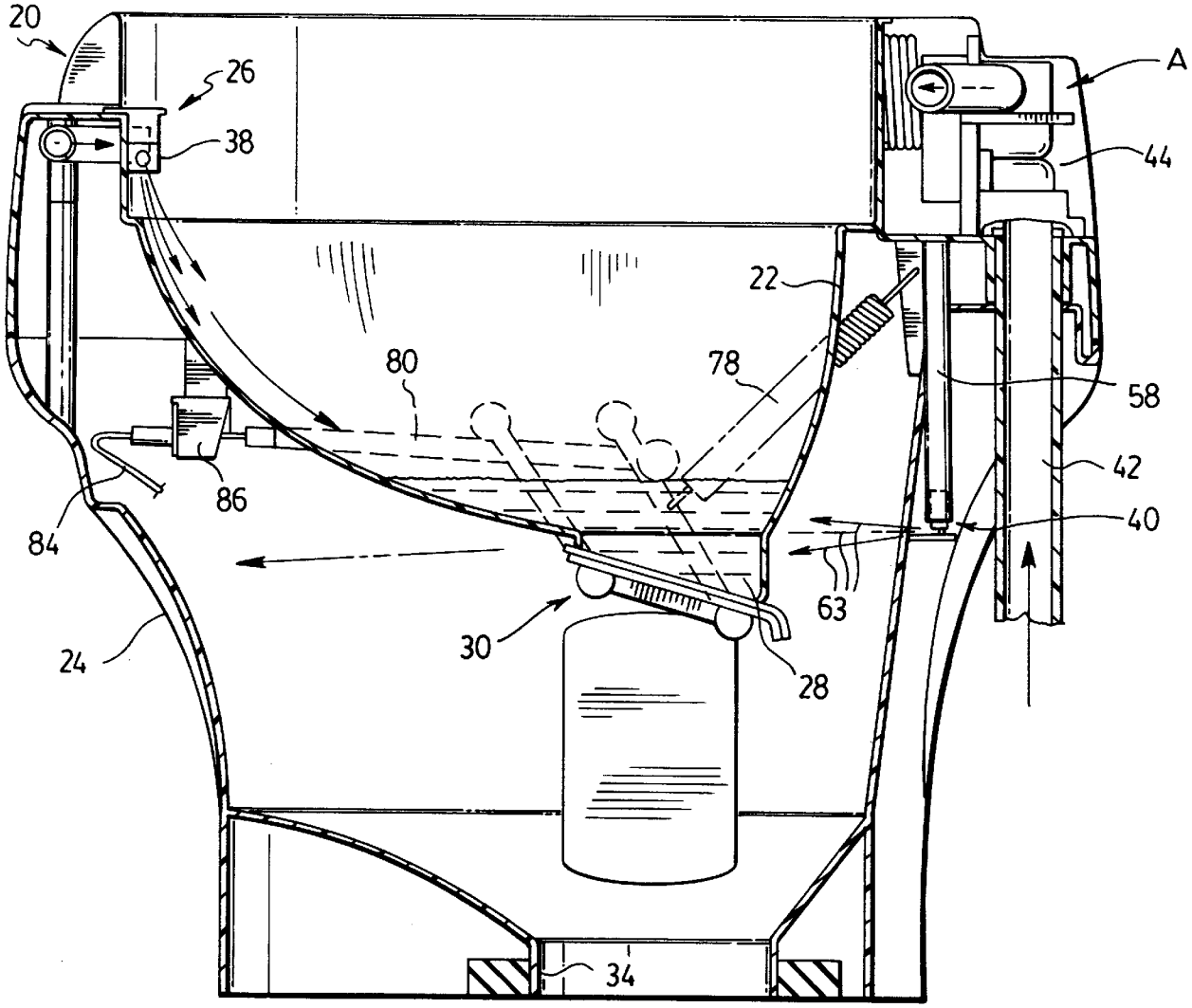
FIG. 3 is a view similar to FIG. 2 but in which the toilet bowl is also shown in section and the bowl seal valve is shown closed.

The drawings show a toilet of the same general form as that shown in the '988 Stewart patent (supra). Referring first to FIG. 1, the toilet includes a first plastic moulding 20 that is shaped to define a waste receiving bowl 22 of the toilet, and a second plastic moulding 24 that forms a shell or outer housing in which the bowl is supported. In FIG. 1, the first moulding 20 and associated components are shown in an exploded position above moulding 24. The two mouldings are designed to fit together in the assembled toilet so that the moulding 20 is supported on moulding 24 as best shown in FIGS. 2 and 3. Moulding 24 includes various support posts 24*a* (FIG. 1) which assist in supporting the weight of a person seated on moulding 20.

Typically, moulding 20 will be fitted with at least a lid and possibly also a lift-up seat (not shown in the drawings).

FIG. 3 best shows the bowl 22 as seen in section. The bowl has a rim 26 from which water is dispensed when the toilet is flushed (to be described), and a waste outlet 28 at its lower end, which is controlled by a valve comprising a bowl seal member 30.

The housing formed by moulding 24 defines an internal space 32 in which the bowl outlet 28 is located, and has a main outlet 34 from the toilet below the bowl outlet so that waste from the bowl passes by gravity to the main waste outlet. Surrounding outlet 34 is a recess 36 for receiving the usual gasket for sealing with a waste discharge conduit in a recreational vehicle. Provision is made for securing the toilet over an inlet flange to the conduit in conventional fashion; for convenience, the securing means have not been shown.

In accordance with the invention, the toilet is provided with both a bowl rinsing nozzle 38 adjacent the rim 26 of the toilet bowl 22, for rinsing waste from the surface of the bowl towards outlet 28, and an internal rinse nozzle 40 within the internal space 32 of moulding 24, for rinsing waste that may tend to accumulate in that space when the toilet is in use.

Figure 4:
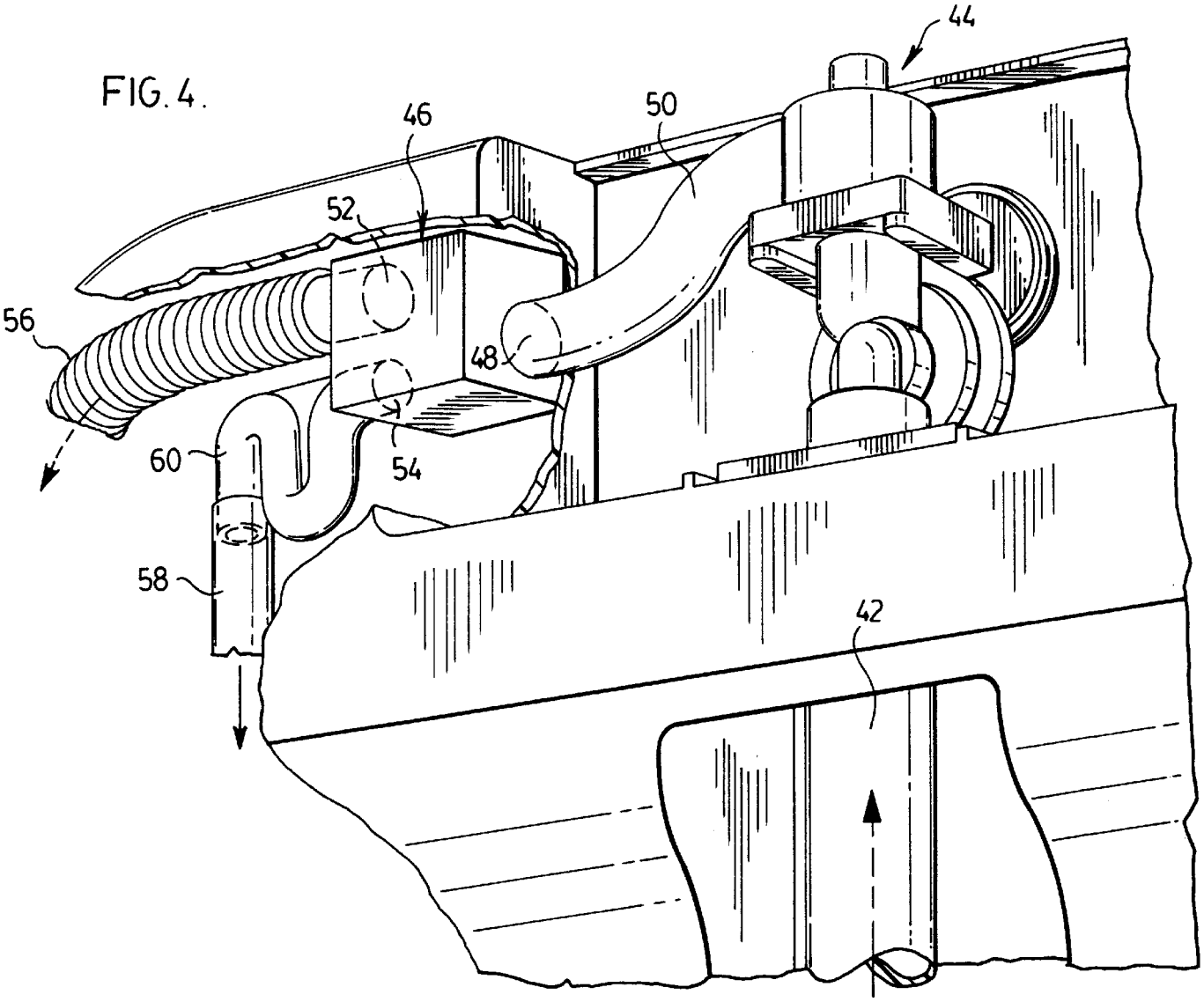
FIG. 4 is a perspective view of part of the main water control valve and associated water diffuser of the toilet, generally as seen in the direction of arrow "A" in the top right hand portion of FIGS. 2 and 3; and, FIGS. 5*a* and 5*b* are vertical sectional views through the diffuser respectively during a rinse cycle (FIG. 5*a*) and following completion of the rinse cycle (FIG. 5*b*).

As best seen in FIG. 4, the toilet has a main inlet pipe 42, which communicates with the two nozzles 38 and 40 respectively by way of a water valve 44 and a diffuser chamber 46 downstream of the valve. Chamber 46 has a single inlet 48 which communicates with valve 44 by way of a pipe 50, and two outlet openings 52 and 54 which communicate respectively with the bowl rinse nozzle 38 and the internal rinse nozzle 40. FIGS. 4 and 5 show that the first chamber outlet opening 52 (communicating with the bowl rinse nozzle 38) is of larger diameter than the second outlet 54 opening (communicating with the internal rinse nozzle 40).

Pipes 56 and 58 of corresponding respective diameters connect the two outlet openings with the respective nozzles. In this embodiment, a corrugated pipe 56 is used to connect to the bowl rinse nozzle 38 while a straight generally upright pipe 58 is used to connect to the internal rinse nozzle. It will also be noted that a so-called "goose neck" or S-trap 60 is used between pipe 58 and chamber 46. In the embodiment, the trap is formed as part of chamber 46 (e.g. as a one-piece plastic moulding). However, this is not essential; the trap may be located at any convenient point between the diffuser and nozzle 40.

Figure 5A:
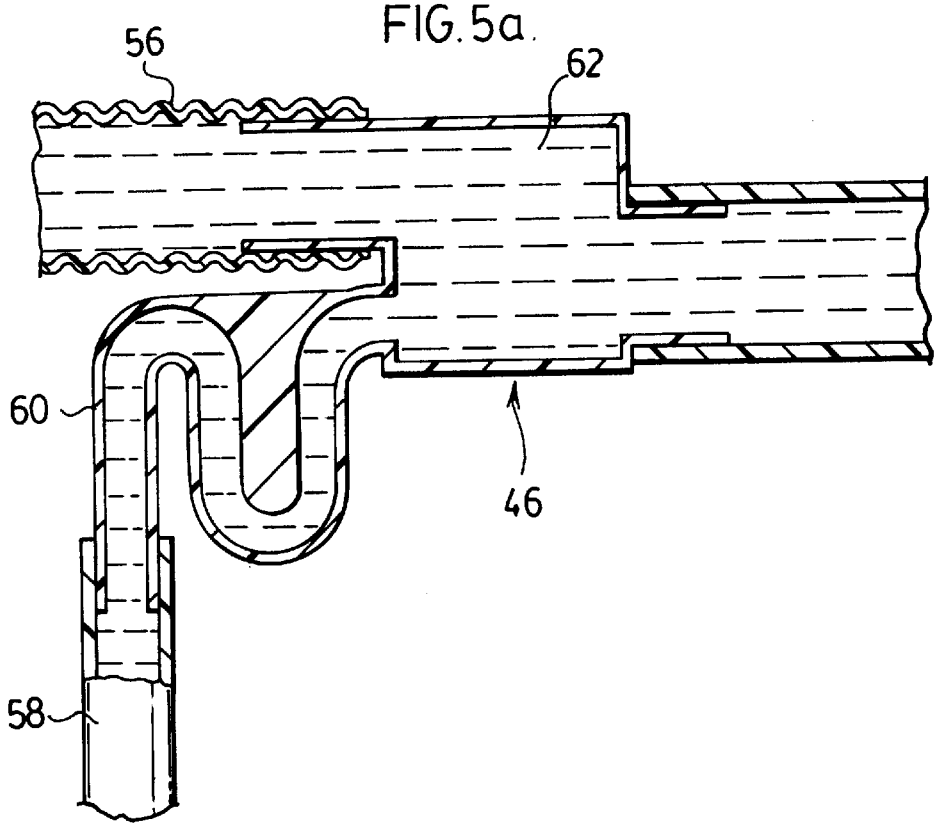
Figure 5B:
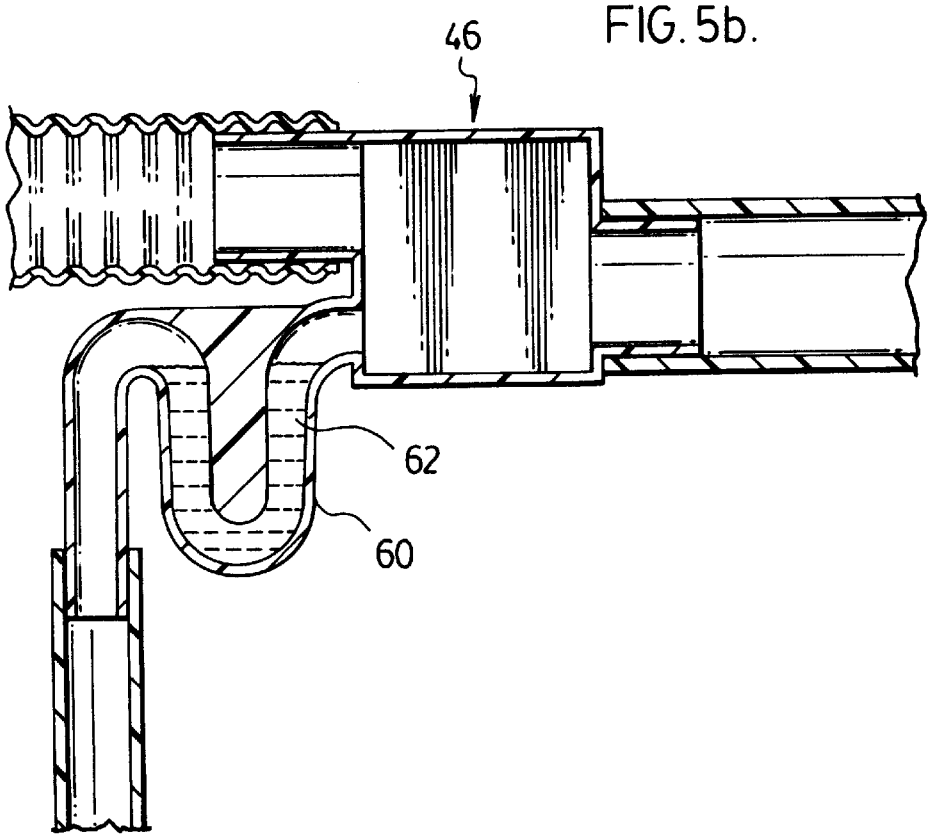

FIGS. 5*a* and 5*b* show the diffuser chamber 46 in vertical section. As seen in FIG. 5*a*, flush valve 44 (FIG. 4) has been opened, allowing water to flow under pressure into chamber 46, completely filling the diffuser chamber 46 and flowing into both of the pipes 56 and 58. Inlet 48 is located opposite to and generally in line with outlet 54 so that the pressure of the incoming water is communicated directly to internal rinse nozzle 40. At the same time, the volume of water entering chamber 46 is such as to overwhelm the chamber and almost instantly fill pipe 56. FIG. 5*a* illustrates the size differential between the two outlets 52 and 54. Pipe 56 (and hence the bowl rinse nozzle 38) will receive a relatively high volume of water compared with the volume of water that enters pipe 58 and flows to nozzle 40. Accordingly, a relatively large volume of water will be discharged from nozzle 38 (FIG. 3) for flushing the toilet bowl. At the same time, a relatively strong jet or jets of water (but of lower total volume) will be discharged by the internal rinse nozzle 40 for flushing accumulated waste and other debris within the internal space 32 of the toilet housing.

In FIGS. 2 and 3, the arrows denoted 63 illustrate the fact that nozzle 40 is designed to direct a relatively broad fan-shaped spray towards and beyond the bowl seal 30 of the toilet so as to promote good rinsing of both the seal and of the internal surfaces of the toilet housing. FIG. 2*a* shows the internal rinse nozzle 40 is some detail. It will be seen that the nozzle includes a cylindrical sleeve 40*a* which is push-fitted within the lower end of pipe 58 in the assembled toilet, and secured with hose-clamp (not shown). Disposed at the lower end of and extending transversely with respect to the longitudinal axis of sleeve 40*a* is an end plate 40*b* which is generally disc-shaped but positioned offset with respect to sleeve 40*a* to the left as seen in FIG. 2*a*, i.e. so that more of plate 40*a* extends outwardly beyond sleeve 40*a* at one side than the other. The nozzle is positioned with this side facing in the forward direction of the toilet, i.e. to the left in FIGS. 2 and 3. A transverse spacer element 40*c* extends between the sleeve 40*a* and the plate 40*b* and maintains the lower end of the sleeve at a spacing above the plate so that, in effect, a slot of almost 360 ° extent is provided between the sleeve and the plate.

Accordingly, water that enters sleeve 40*a* from pipe 58 impinges against the top surface of plate 40*b* and is deflected laterally outwardly in a spray pattern of almost 360° around nozzle 40. Spacer element 40*c* is in fact offset to the right as seen in FIG. 2*a* so that a smaller water outlet gap exists at the rear of the nozzle (to the right in FIG. 2*a*) than to the front (the left). Accordingly, a greater volume of water will be directed forwardly in the direction of the arrow 63 although some water will be directed rearwardly against the rear surface of shell 24.

The bowl rinsing nozzle 38 may be arranged to discharge multiple streams, for example in a "fan pattern" for good rinsing of the bowl. In an alternative embodiment, multiple bowl rinsing nozzles or a ring having multiple discharge apertures may be provided, as is known in the art.

Fig. 5*b* shows the diffuser chamber 56 after water valve 44 has been closed. It will be seen that a residual body 62' of rinse water will remain in trap 60. This prevents backflow of odours from the interior of the toilet.

Reverting to FIGS. 2 and 3, the precise form of bowl seal member 30 is not significant. A number of different types of seals or valves are known in the art. In this particular embodiment, the seal member is in the form of a plate 64 which is pivotally suspended from the toilet bowl 22 by respective pairs of links at opposite sides of the bowl, one pair of which is visible in FIGS. 1, 2 and 3, the individual links being denoted 66 and 68. The links in each pair are of unequal lengths and are coupled to respective pivot points 70 and 72 on the bowl and 74 and 76 on plate 64. The respective lengths of the links and their pivot points are arranged so that plate 64 can swing between a position which is clear of bowl outlet 28 (as shown in FIG. 2) and a position in which the plate moves upwardly into contact with and fits snugly against the mouth of bowl outlet 28 (as seen in FIG. 3). This upward motion ensures good sealing without causing abrasion such as would occur if the bowl seal member were to be moved purely laterally while in contact with the bowl outlet.

A tension spring 78 extends between link 68 and a fixed point within the toilet housing to spring bias the plate 64 to the bowl closing position (FIG. 3).

The valve can be opened by a yoke 80 (see FIG. 1) which engages link 68 at a pivot point 82. Yoke 80 extends towards the left (front) of the toilet as seen in FIGS. 2 and 3 and is coupled to a cable 84 at a fitment 86 which is fixed within the toilet housing. Cable 84 then extends to a suitable actuating member such as a foot pedal or a handle, operation of which will cause cable 84 to be pulled, for opening valve 30 against the action of spring 78. Release of the actuating member will allow the valve to close under the influence of spring 78.

As indicated above, the precise structure of bowl seal 30 and its manner of actuation do not form part of the invention and can be accomplished in any of a number of ways known per se in the art. Typically, the water valve 44 will also be cable-operated from the same actuating member, also as well-known in the art.

Referring to foot pedal actuation by way of example, the arrangement is preferably such that water valve 44 is opened initially upon operation of the foot pedal, initiating discharge of water from the bowl rinse nozzle 38 and from the internal rinse nozzle 40. Continued depression of the foot pedal opens valve 30 so that the contents of the bowl are discharged. Conversely, as the pedal is released, valve 30 closes first, followed by the water valve 44. In this way, water continues to discharge from nozzle 38 after valve 30 has closed, so that a body of water remains in the lower portion of the bowl ready for the next the toilet is used.

A suitable foot pedal actuator is disclosed in the '988 Stewart patent.

It will of course be appreciated that the preceding description relates to a particular preferred embodiment of the invention only and that many modifications are possible within the broad scope of the claims. Some of those modifications have been mentioned previously and others will be apparent to a person skilled in the art. Other possible modifications include, for example, the use of multiple internal rinse nozzles in place of the single nozzle 40 referred to previously, or a different location of the nozzle within space 32 (as shown, nozzle 40 is located at the rear of the toilet and is directed forwardly). A single nozzle could be centrally located within space 32 (e.g. just to the left of the bowl outlet in FIGS. 2 and 3) and provided with water openings for providing a 360 ° spray pattern. Referring to FIG. 4, an appropriately sized Y connector could be used as a diffuser means in place of chamber 46.

I/We claim:

1. A toilet comprising:

a bowl for receiving waste and having an outlet and a rim;

a housing in which the bowl is supported, the housing defining an internal space in which said bowl outlet is located and having a main waste outlet from the toilet below the bowl outlet, so that waste from the outlet passes by gravity to a main waste outlet;

bowl closure means normally closing said bowl outlet and operable to open the outlet for flushing of the toilet; and, flushing means comprising at least one bowl rinse nozzle adjacent the rim of the bowl, an internal rinse nozzle within said internal space defined by the housing for rinsing waste that may tend to accumulate in said space when the toilet is in use, a water inlet, means providing communication between said inlet and said bowl rinse nozzle and said internal rinse nozzle, including a water valve and diffuser means downstream of said valve having first and second outlets communicating respectively with the bowl rinse nozzle and internal rinse nozzle, the outlets being sized so that the volume of water delivered to the internal rinse nozzle is lower than the volume of water delivered to the bowl rinse nozzle.

2. A toilet as claimed in claim 1, wherein said diffuser means comprises a chamber having a single inlet communicating with said water valve and said first and second outlets, said outlets including respective pipes that communicate with the bowl rinse nozzle and the internal rinse nozzle.

3. A toilet as claimed in claim 2, wherein said inlet is located at a side of said chamber opposite to said second outlet, and generally in line therewith.

4. A toilet as claimed in claim 1, further comprising trap means in said second outlet for retaining a residual body of water and preventing backflow of gases from said internal space through the internal rinse nozzle.

5. A toilet as claimed in claim 4, where in said diffuser means comprises a chamber having a single inlet communicating with said water valve, and said first and second outlets, said outlets including respective pipes that communicate with the bowl rinse nozzle and the internal rinse nozzle, and wherein said trap means is integrally formed with said chamber.

6. A toilet as claimed in claim 1, wherein said internal rinse nozzle is located in said internal space rearwardly of the bowl and is arranged to direct water forwardly towards said bowl closure means.

7. A toilet as claimed in claim 1, wherein said internal rinse nozzle comprises a sleeve for an incoming water stream, the sleeve having an outer end, and a plate disposed transversely with respect to the sleeve and spaced outwardly from said outer end thereof to define a gap through which water issues from the nozzle.

8. A toilet as claimed in claim 7, wherein said plate is generally disc-shaped and of greater diameter than the sleeve, and is offset with respect to the longitudinal axis of the sleeve in a direction in which a maximum volume of water is to be dispensed, and wherein the nozzle further includes a spacer member between the sleeve and the plate positioned in a location offset opposite to said direction so that a reduced volume of water issues from the nozzle in said opposite direction.

* * * * *